US012178269B2

(12) United States Patent
Chen

(10) Patent No.: US 12,178,269 B2
(45) Date of Patent: Dec. 31, 2024

(54) FULLY COATED GLOVE HAVING MOISTURE WICKING PROPERTY

(71) Applicant: ZHANGJIAGANG SIQI SCIENCE AND TECHNOLOGY, CO., LTD, Suzhou (CN)

(72) Inventor: Feng Chen, Suzhou (CN)

(73) Assignee: ZHANGJIAGANG SIQI SCIENCE AND TECHNOLOGY , CO., LTD, Suzhou (CN)

( * ) Notice: Subject to any disclaimer, the term of this patent is extended or adjusted under 35 U.S.C. 154(b) by 0 days.

(21) Appl. No.: 18/024,752

(22) PCT Filed: Jan. 6, 2022

(86) PCT No.: PCT/CN2022/070419
§ 371 (c)(1),
(2) Date: Mar. 4, 2023

(87) PCT Pub. No.: WO2023/123533
PCT Pub. Date: Jul. 6, 2023

(65) Prior Publication Data

US 2024/0277089 A1 Aug. 22, 2024

(30) Foreign Application Priority Data

Dec. 27, 2021 (CN) ..... 202111612123.7

(51) Int. Cl.
*A41D 31/12* (2019.01)
*D06N 3/00* (2006.01)
*D06N 3/14* (2006.01)

(52) U.S. Cl.
CPC ..... *A41D 31/125* (2019.02); *D06N 3/0009* (2013.01); *D06N 3/0043* (2013.01); *D06N 3/14* (2013.01); *D06N 2209/126* (2013.01); *D06N 2209/128* (2013.01); *D06N 2211/103* (2013.01)

(58) Field of Classification Search
CPC ..... A41D 31/125; A41D 19/0065; A41D 19/0058; D06N 2211/103
See application file for complete search history.

(56) References Cited

U.S. PATENT DOCUMENTS 5,832,539 A * 11/1998 Williams ..... A41D 31/102 264/222
9,339,068 B2 * 5/2016 Baacke ..... A41D 19/001
11,632,991 B2 * 4/2023 Hull ..... A41D 19/0058 2/167
2006/0143767 A1 * 7/2006 Yang ..... B32B 27/40 442/76
2012/0185997 A1 * 7/2012 Kirk ..... A62B 17/006 2/161.7
2013/0047313 A1 * 2/2013 Windisch ..... D04B 1/28 2/69

* cited by examiner

*Primary Examiner* — Tajash D Patel
(74) *Attorney, Agent, or Firm* — Li & Cai Intellectual Property (USA) Office

(57) ABSTRACT

A fully coated glove having a moisture wicking property is provided, which includes a palm body, a moisture wicking layer, and a shielding layer. Each of the moisture wicking layer and the shielding layer is prepared by using a raw material including waterborne polyurethane or solvent-based polyurethane. The moisture wicking layer is a foam layer with a thickness of 0.1 mm to 0.3 mm; the shielding layer is a non-foam layer with a thickness of 0.03 mm to 0.2 mm. The preparation process includes following steps: molding of the palm body; preparing the moisture wicking layer that is foamed by coating; water washing; drying; preparing the shielding layer that is not foamed by coating; drying; demolding of the finished product; and packaging. Polyurethane is used as the raw material of the coating in the glove provided by the present disclosure, so as to associatedly combine the foam layer and non-foam layer.

7 Claims, No Drawings

FULLY COATED GLOVE HAVING MOISTURE WICKING PROPERTY

FIELD OF THE DISCLOSURE

The present disclosure relates to a field of labor protection appliances, and more particularly to a fully coated glove having a moisture wicking property.

BACKGROUND OF THE DISCLOSURE

It is well known that safety protection is very important in modern industrial production, and wearing protective glove is an important part of the safety protection. The commercially available coated labor safety gloves are divided into a fully coated type and a palm coated type. Main components of the coating of the palm coated type labor protection glove are nitrile, natural latex, PVC, and polyurethane. Wearing such glove can achieve a certain level of protection, while it is helpless against the intrusion of external liquids or bacteria since a back of the hand is not coated. For certain occasions, such as a working environment being relatively humid or having oil pollution such as lubricating oil, and in cases where there is a risk of bacteria or virus intrusion such as contact with medical waste, it is necessary to maintain a good shield coating between the hands and external objects. Accordingly, the palm coated type glove is obviously not suitable, and the fully coated type glove is a must-worn. Main raw materials of a coating of the fully coated type glove are nitrile, natural latex, and PVC. Because of the need to shield the intrusion of the external liquids or bacteria, all such commercially available products currently do not have a moisture wicking property, and the hand feeling is relatively hard, so that the wearing experience may be very uncomfortable. When wearing such gloves for a long time, the skin of the hands is soaked in sweat, which may easily cause skin wrinkles. In addition, such gloves easily become breeding grounds for bacterial and increase work fatigue.

SUMMARY OF THE DISCLOSURE

The purpose of the present disclosure is to provide a fully coated glove having a moisture wicking property.

The inventor has studied and found that a principle of waterproof and moisture wicking property of a coating is that the moisture wicking property of a film is achieved through two ways. One is non-porous and hydrophilic. A water molecule is composed of one oxygen atom and two hydrogen atoms. When the water molecule is in a gaseous state, there is almost no force between the water molecules, and the water molecule can move freely. When the water molecules inside a shielding layer come into contact with the film in gaseous form, hydrophilic groups contained in the film can absorb the water molecules, and transfer the water molecules from an inner layer with high concentration to an outer layer with low concentration through a molecular chain, and then the water molecules are volatilized into the air, so as to complete a complete process of adsorption-transfer-desorption. At this time, the shielding layer produces phenomenon of moisture absorption and breathability. The concentration and temperature difference of water molecules inside and outside the shielding layer are the influencing factors of the conduction rate. The greater the difference, the faster the conduction rate. However, when the water molecule is in a liquid state, a bonding force between molecules is relatively large, including van der Waals force and hydrogen bonds. Therefore, although the hydrophilic groups in the film are in contact with liquid water, the adsorption force between the shielding layer and the water molecules is less than the binding force between the water molecules, so that the liquid water cannot be conducted to the other side through the shielding layer. At this time, the shielding layer plays a role of waterproofing. In addition, because the shielding layer is a non-porous design, bacteria and viruses cannot pass through the shielding layer, which is the principle that the shielding layer is not only breathable, but also waterproof and anti-virus. The second way to achieve the moisture wicking property of the film is using microporous evacuation. A moisture wicking layer of the present disclosure adopts such method. When a hand of a wearer generates sweat, a volume of a gaseous water molecule is much smaller than an aperture of the micropore, so that the gaseous water can freely contact the shielding layer through the moisture wicking layer, and then diffuse to the outside of the glove through the shielding layer. However, if an amount of the sweat generated is greater than a diffusion speed of the shielding layer, the microporous moisture wicking coating can temporarily absorb and store excess sweat. In addition, the moisture wicking coating of the present disclosure concurrently has the hydrophilic groups, so that it has both microporous hydrophobic and hydrophilic moisture absorption functions, and can slow down or even eliminate the stuffy and wet feeling of hands caused by sweat as much as possible.

According to the above principles, a hydrophilic property of the coating in contact with the skin and a number of micropores play important roles. At present, a raw material of fully coated products that are commercially available is nitrile or PVC. From the point of view of the structures of these two raw materials, these two raw materials are relatively poor hydrophilic. Especially, the PVC material is not hydrophilic at all. According to the analysis of the process, these two materials do not have a foam process and a foam section. Therefore, the hydrophilicity and micropores of the fully coated glove made of these two raw materials are not enough, or even not, resulting in glove that does not have moisture absorption effect and the feel is relatively hard.

This present disclosure uses polyurethane as a raw material for the inner layer, which solves the problems of hydrophilicity and moisture wicking from the chemical composition and physical structure. First of all, from the perspective of chemical composition, the commercially available polyurethane raw materials are divided into two types, i.e., a solvent-based type and a waterborne type. No matter which type, they all have a certain number of hydrophilic groups, e.g., carboxyl, hydroxyl or amino groups, and these groups can strongly adsorb gaseous water molecules. From the point of view of physical structure, during processes of water-washing and film-forming of solvent-based polyurethane after coating, due to an exchange of solvent and water, the resulting polyurethane film forms a large number of fine pores. However, a process of physical foaming before molding is adopted for waterborne polyurethane, so that the waterborne polyurethane also contains a large number of fine pores. These fine pores have two advantages. One is that a specific surface area of the coating is greatly increased, that is, a contact area between the water molecule and the hydrophilic material is increased. In this way, during the use of glove, the gaseous sweat can maximize the contact with the hydrophilic groups of the coating and be absorbed, and then be channeled to the outside of the glove through the shielding layer. If the sweat is generated faster than it is discharged, excess sweat will be attracted by a large number of microporous capillaries, and held by the coating and fibers so as to be mechanically held in the capillaries between the fibers. The other is because there are the large numbers of fine pores, softness of the coating is greatly improved. This is a very important indicator in an actual use of glove. Soft glove can reduce the fatigue of hands during work and reduce labor intensity to the greatest extent.

The present disclosure is achieved through the following technical solutions:

In one aspect, the present disclosure provides a fully coated glove having a moisture wicking property, which includes a palm body that is knitted, a moisture wicking layer fully coated on an inner surface of the palm body, a shielding layer fully coated on an outer surface of the palm body, each of the moisture wicking layer and the shielding layer is prepared by coating using a raw materials including waterborne polyurethane or solvent-based polyurethane, the moisture wicking layer is a foam layer with a thickness of 0.1 mm to 0.3 mm, the shielding layer is a non-foam layer with a thickness of 0.03 mm to 0.2 mm, and the specific preparation process of the fully coated glove includes following steps: molding of the palm body; preparing the moisture wicking layer that is foamed by coating; water washing; drying; preparing the shielding layer that is not foamed by coating; drying; demolding of the finished product; and packaging. When a second coating layer that is the shielding layer is coat, a first layer that is the moisture wicking layer is ensured to be cured and dried into a film, and a surface energy of a shielding layer coating in a liquid state is ensured to be lower than the surface energy of the moisture wicking layer, so that the shielding layer coating infiltrates into a surface of the moisture wicking layer at a maximum level and even into micropores of a surface layer. Because the low surface energy can make the shielding coating material soak into the surface of the moisture wicking layer or even the micropores of the surface layer to the greatest extent, through sufficient interfacial contact, it is absorbed by the moisture wicking layer. During the subsequent heating process, the shielding layer rubber under the action of Brownian motion, the molecules are closely combined with the molecules of the moisture wicking layer, and the two-layer coating forms a stable state under the joint action of Van der Waals force and hydrogen bonds. Therefore, strictly controlling the surface energy of the shielding layer is the key to making the two-layer coating have high bonding strength.

In certain embodiments, when the shielding layer is prepared by coating using the raw material including a waterborne polyurethane resin, a solid content of the coating is maintained between 20% and 40% and a viscosity of the coating is maintained between 500 centipoises and 2000 centipoises so as to ensure that the thickness of the shielding layer is 0.03 mm to 0.2 mm; when the shielding layer is prepared by coating using the raw material including a solvent-based polyurethane resin, the solid content of the coating is maintained between 12% and 20% and the viscosity of the coating is maintained between 300 centipoises and 1500 centipoises.

In certain embodiments, when the shielding layer is prepared by coating using the raw material including the waterborne polyurethane resin, the raw material includes the following components: a waterborne polyurethane emulsion, a defoamer, a thickener, a curing agent, and a wetting agent; when the shielding layer is prepared by coating using the raw material including the solvent-based polyurethane resin, the raw material includes the following components: a dry polyurethane resin, DMF, the defoamer, a leveling agent, a penetrating agent, and the wetting agent.

In certain embodiments, when the shielding layer is prepared by coating using the raw material including the waterborne polyurethane resin, the raw material includes the following components and parts by mass thereof: 1000 parts by mass of the waterborne polyurethane emulsion, 4 to 7 parts by mass of the defoamer, 3 to 8 parts by mass of the thickener, 10 to 30 parts by mass of the curing agent, and 2 to 5 parts by mass of the wetting agent; when the shielding layer is prepared by coating using the raw material including the solvent-based polyurethane resin, the raw material includes the following components and parts by mass thereof: 1000 parts by mass of the dry polyurethane resin, 800 to 2000 parts by mass of DMF, 3 to 10 parts by mass of the defoamer, 3 to 8 parts by mass of the leveling agent, 3 to 8 parts by mass of the penetrating agent, and 2 to 5 parts by mass of the wetting agent.

In certain embodiments, when the moisture wicking layer is prepared by coating using raw material including a waterborne polyurethane resin, a solid content of the coating is maintained between 20% and 40%, a viscosity is maintained between 500 centipoises and 2000 centipoises and an expansion ratio is maintained between 1.15-1.8 so as to ensure that the moisture wicking layer with the thickness of 0.1 mm to 0.3 mm; because for waterborne polyurethane resin, the coating thickness can be freely maintained between 0.1 mm to 0.3 mm when the solid content of the coating is maintained between 20% and 40% and the viscosity is maintained between 500 centipoises and 1500 centipoises; when the moisture wicking layer are prepared by coating using raw materials including a solvent-based polyurethane resin, solid content of the coating is maintained between 12% and 18% and the viscosity of the coating is maintained between 500 centipoises and 1500 centipoises; because according to the foaming principle of solvent-based resin, by adjusting the solid content of the resin, adding a solidification speed regulator and a cell regulator, by adding a solidification speed regulator, the solidification speed of the resin after entering the water can be changed, so that the surface layer resin density decreases. At the same time, add cell aid to reduce the probability of large-diameter fine pores, and the appropriate range of the solid content of the coating is maintained between 12% and 18%. At the same time, control the viscosity between 500 centipoises and 1500 centipoises, the coating thickness can be freely maintained between 0.1 mm to 0.3 mm.

In certain embodiments, when the moisture wicking layer are prepared by coating using the raw materials including waterborne polyurethane resin, the prepared raw materials include the following components: a waterborne polyurethane emulsion, a foam agent and a thickener, a foam agent is add between 5% and 15% of the mass of the waterborne polyurethane emulsion; when the moisture wicking layer are prepared by coating using the raw material including a solvent-based polyurethane resin, the prepared raw material includes the following components: a wet polyurethane resin, a DMF, a defoamer, a penetrating agent, a cell aid, an accelerator, solid content of the coating is maintained between 12% and 18%. Because according to the foaming principle of solvent-based resin, adding a solidification speed regulator and a cell aid to adjust the solid content of the resin, adding a solidification speed regulator to change the solidification speed of the resin after entering the water, so that the density of the resin on the surface layer decreases, and at the same time adding a cell adjustment agent to reduce the probability of large-diameter fine pores, and the control range of the solid content of the coating is more appropriate to be maintained between 12% and 18%.

In certain embodiments, when the moisture wicking layer are prepared by coating using the raw material including waterborne polyurethane resin, the prepared raw material includes the following components and mass: 1000 parts by mass of the waterborne polyurethane emulsion, 50-150 parts by mass of the foam agent and 2-6 parts by mass of the thickener; when the moisture wicking layer are prepared by coating using raw materials including solvent-based polyurethane resin, the prepared raw materials include the following components and mass: 1000 parts by mass of the wet polyurethane resin, 800 to 2000 parts by mass of the DMF, 3 to 10 parts by mass of the defoamer, 3 to 8 parts by mass of the penetrating agent, 2 to 8 parts by mass of the cell aid and 5 to 15 parts by mass of the accelerator.

When making fully coated glove, the formulas of the raw materials used for the moisture wicking layer and the shielding layer can be combined arbitrarily according to needs.

The above parameters were chosen for the following reasons:

1. For the moisture wicking layer, two points need to be paid attention to.

(1) The size and the number of the pores. The pores of the moisture wicking coating per unit volume are within a reasonable range. If the number is larger, the pores size is smaller, indicating that the specific surface area of the pores is larger, which is beneficial to moisture wicking property (it should be noted here that the size of the pores is not smaller than a range that hinders a free passage of water vapor molecules). If the moisture wicking layer is made of the waterborne polyurethane, we believe that a foam ratio is between 1.15 and 1.8, which is a reasonable range, and the number and diameter of pores can be controlled by the amount of foam agent added. The amount of foam agent added is generally 5% to 15% of the amount of resin. If the moisture wicking layer is prepared with the solvent-based polyurethane, according to the foaming principle of solvent-based resin, a desired goal can be achieved by adjusting a solid content of the coating, and adding a solidification speed regulator and a cell regulator. Conventional solvent-based polyurethane glove resin, a solidification speed of the surface after entering the water is very fast, resulting in a very dense coating surface similar to the plastic skin. By adding a solidification speed regulator, the solidification speed of the resin after entering the water can be changed, so that the resin density of the surface layer decreases. At the same time, a cell adjustment additive is added to reduce the probability of large-diameter cells, and the control range of the solid content of the coating is more appropriate to be maintained between 12% and 18%. Combining the above three factors, the specific surface area of the entire moisture wicking layer can be controlled within a reasonable range.

(2) The thickness of the coating, because there are a large number of tiny holes, the thickness of the coating has a slight influence on the breathability of the moisture wicking layer, because the thicker the thickness, the longer the path for the water molecules to pass through the coating, which is not conducive to breathability. For moisture absorption, under the premise that the number of pores per unit volume is constant, the thicker the coating, that is, the more storage space that can be used to absorb and lock moisture, so it is beneficial to moisture absorption. But similar to the shielding layer, a thicker coating will also have a negative impact on the dexterity and touch of the fingers. Through certification, we believe that it is more appropriate to control the thickness of the coating between 0.1 mm and 0.3 mm. When specifying the production process, the thickness of the coating can be achieved by adjusting the viscosity and solid content of the coating. For the same viscosity, the higher the solid content of the coating, the thicker the coating; for the same solid content, the higher the viscosity of the coating, the thicker the coating. For the waterborne polyurethane resin, the solid content of the coating is 20% to 40%, the viscosity is between 500 centipoises and 2000 centipoises, and the foam ratio is maintained between 1.15 and 1.8, so that the coating thickness can be freely maintained between 0.1 mm and 0.3 mm. For the solvent-based polyurethane, the solid content of the coating is 12% to 18%, the viscosity is between 500 centipoises and 1500 centipoises, and the coating thickness can be freely maintained between 0.1 mm and 0.3 mm.

2. For the shielding layer, we need to strictly control the thickness of the coating. A thick coating is beneficial to the shielding effect, but the disadvantage is that the path of water molecules passing through the shielding layer are lengthened in terms of breathability, which reduces the breathability of the coating. In addition, the thick coating also negatively affects the dexterity and tactility of the fingers of the wearer during work. With a thin coating, the path of the water molecules passing through the shielding layer becomes shorter, which increases the breathability of the coating and sensitivity to touch. The disadvantage is that the continuous shielding effect may be reduced. In addition, it will also have a serious negative impact on the durability of the glove. Therefore, it is more critical to select an appropriate coating thickness. Through certification, it is considered that the thickness of the coating should be controlled between 0.03 mm and 0.2 mm. When specifying the production process, the thickness of the coating can also be achieved by adjusting the viscosity and solid content of the coating. For the waterborne polyurethane resin, the solid content of the coating is 20% to 40%, and the viscosity is between 500 centipoises and 2000 centipoises. For the solvent-based polyurethane, the solid content of the coating is 12% to 20%, and the viscosity is between 300 centipoises and 1500 centipoises, so that the coating thickness can be freely maintained between 0.03 mm and 0.2 mm.

3. Adhesion strength between the moisture wicking layer and the shielding layer. The principle of bonding is that after two layers of adherents are in contact with each other, a force is generated between the molecules, so that the two adherents are combined. Specifically, in the process of the present disclosure, when the second layer of glue (shielding layer) is coating, the first moisture wicking layer has been cured and dried to form a film. To improve the bonding strength between the moisture wicking layer and the shielding layer, it is necessary to have the surface energy of the liquid shielding layer coating lower than that of the moisture wicking layer. Because the low surface energy can make the shielding coating material soak into the surface of the moisture wicking layer to the greatest extent or even into the micropores of the surface layer, and be absorbed by moisture wicking layer through sufficient interface contact. During the subsequent heating process, the rubber molecules of the shielding layer are closely combined with the molecules of the moisture wicking layer under an action of Brownian motion. Therefore, strictly controlling the surface energy of the shielding layer is the key to making the two-layer coating have high bonding strength.

The beneficial effect of the present disclosure is that:

The fully coated gloves having the moisture wicking property of the present disclosure have an ingenious structure. Aiming at the deficiencies of various gloves currently on the market, the present disclosure adopts the method of secondary coating to creatively achieve moisture absorption, breathability and shielding isolation. Such functions are combined into one glove, which perfectly solves the shortcomings of the market. The present disclosure uses polyurethane as the coating raw material, and organically combines the foam coating (mainly for moisture wicking property) and the non-foam coating (mainly for shielding and isolation functions), so that the product has functions of moisture wicking property and shielding isolation, and soft hands feeling, which greatly reduces the fatigue of work. It has a wider application range and strong practicability, worth promoting.

DETAILED DESCRIPTION OF THE EXEMPLARY EMBODIMENTS

A fully coated glove having a moisture wicking property, which includes a palm body that is knitted, a moisture wicking layer fully coated on an inner surface of the palm body, a shielding layer fully coated on an outer surface of the palm body, each of the moisture wicking layer and the shielding layer are prepared by coating using a raw material including waterborne polyurethane or solvent-based polyurethane, the moisture wicking layer is a foam layer with a thickness of 0.1 mm to 0.3 mm, the shielding layer is a non-foam layer with a thickness of 0.03 mm to 0.2 mm, and the preparation process of the fully coated glove includes following steps: molding of the palm body; preparing the moisture wicking layer that is foamed by coating; water washing; drying; preparing the shielding layer that is not foamed by coating; drying; demolding of the finished product; and packaging. when a second coating layer that is the shielding layer is coated, a first layer that is the moisture wicking layer is ensured to be cured and dried into a film, and a surface energy of a shielding layer coating in a liquid state is ensured to be lower than a surface energy of the moisture wicking layer, so that the shielding layer coating infiltrates into a surface of the moisture wicking layer at a maximum level and even into micropores of a surface layer. Because the low surface energy can make the shielding coating material soak into the surface of the moisture wicking layer or even the micropores of the surface layer to the greatest extent, through sufficient interfacial contact, it is absorbed by the moisture wicking layer. During the subsequent heating process, the shielding layer rubber under the action of Brownian motion, the molecules are closely combined with the molecules of the moisture wicking layer, and the two-layer coating forms a stable state under the joint action of Van der Waals force and hydrogen bonds. Therefore, strictly controlling the surface energy of the shielding layer is the key to making the two-layer coating have high bonding strength.

When the shielding layer is prepared by coating using the raw material including a waterborne polyurethane resin, a solid content of the coating is maintained between 20% and 40% and a viscosity of the coating is maintained between 500 centipoises and 2000 centipoises so as to ensure that the thickness of the shielding layer is 0.03 mm to 0.2 mm; when the shielding layer is prepared by coating using the raw material including a solvent-based polyurethane resin, the solid content of the coating is maintained between 12% and 20% and the viscosity of the coating is maintained between 300 centipoises and 1500 centipoises.

When the shielding layer is prepared by coating using the raw material including the waterborne polyurethane resin, the raw material includes the following components: a waterborne polyurethane emulsion, a defoamer, a thickener, a curing agent, and a wetting agent; when the shielding layer is prepared by coating using the raw material including the solvent-based polyurethane resin, the raw material includes the following components: a dry polyurethane resin, DMF, the defoamer, a leveling agent, a penetrating agent, and the wetting agent.

Specifically, when the shielding layer is prepared by coating using the raw material including the waterborne polyurethane resin, the raw material includes the following components and parts by mass thereof: 1000 parts by mass of the waterborne polyurethane emulsion, 4 to 7 parts by mass of the defoamer, 3 to 8 parts by mass of the thickener, 10 to 30 parts by mass of the curing agent, and 2 to 5 parts by mass of the wetting agent; when the shielding layer is prepared by coating using the raw material including the solvent-based polyurethane resin, the raw material includes the following components and parts by mass thereof: 1000 parts by mass of the dry polyurethane resin, 800 to 2000 parts by mass of DMF, 3 to 10 parts by mass of the defoamer, 3 to 8 parts by mass of the leveling agent, 3 to 8 parts by mass of the penetrating agent, and 2 to 5 parts by mass of the wetting agent.

When the moisture wicking layer is prepared by coating using raw material including a waterborne polyurethane resin, a solid content of the coating is maintained between 20% and 40%, a viscosity is maintained between 500 centipoises and 2000 centipoises and an expansion ratio is maintained between 1.15-1.8 so as to ensure that the moisture wicking layer with the thickness of 0.1 mm to 0.3 mm; when the moisture wicking layer are prepared by coating using raw materials including a solvent-based polyurethane resin, solid content of the coating is maintained between 12% and 18% and the viscosity of the coating is maintained between 500 centipoises and 1500 centipoises; the moisture wicking layer is prepared by coating using raw material including a waterborne polyurethane resin, the prepared raw material include the following components: a waterborne polyurethane emulsion, a foam agent and a thickener, a foam agent is add between 5% and 15% of the mass of the waterborne polyurethane emulsion; when the moisture wicking layer are prepared by coating using the raw material including a solvent-based polyurethane resin, the prepared raw material includes the following components: a wet polyurethane resin, a DMF, a defoamer, a penetrating agent, a cell aid, an accelerator, solid content of the coating is maintained between 12% and 18%.

Specifically, when the moisture wicking layer are prepared by coating using raw material including the waterborne polyurethane resin, the prepared raw material includes the following components and mass: 1000 parts by mass of the waterborne polyurethane emulsion, 50 to 150 parts by mass of the foam agent and 2 to 6 parts by mass of the thickener; when the moisture wicking layer are prepared by coating using the raw materials including solvent-based polyurethane resin, the prepared raw material includes the following components and mass: 1000 parts by mass of the wet polyurethane resin, 800 to 2000 parts by mass of the DMF, 3 to 10 parts by mass of the defoamer, 3 to 8 parts by mass of the penetrating agent, 2 to 8 parts by mass of the cell aid and 5 to 15 parts by mass of the accelerator.

When making fully coated glove, the formulas of the raw materials used for the moisture wicking layer and the shielding layer can be combined arbitrarily according to needs.

Wherein, the used waterborne polyurethane emulsion, dry polyurethane resin and wet polyurethane resin are all commercially available materials.

Specific Embodiment

The basic formulas for preparing each of the moisture wicking layer and the shielding layer as follows. When making fully coated glove, the formulas of the raw materials used for each of the moisture wicking layer and the shielding layer can be combined arbitrarily according to needs, and the following parts by mass represent 1 gram.

Basic formula 1: The formula of waterborne polyurethane emulsion fully coated shielding layer: 1000 parts by mass of a waterborne polyurethane emulsion (XWB-7248 of Xuchuan Chemical Suzhou Co., Ltd.), 4 to 7 parts by mass of a defoamer (BYK-016), 3 to 8 parts by mass of a thickener (Digao Chemical 3030), 10 to 30 parts by mass of a curing agent (Bayer 3100) and 2 to 5 parts by mass of a wetting agent (DuPont Chemical Capstone FS-63).

Basic formula 2: waterborne polyurethane emulsion fully coated moisture wicking layer formula: 1000 parts by mass of a waterborne polyurethane emulsion (XWB-7510B of Xuchuan Chemical Suzhou Co., Ltd.), 50 to 150 parts by mass of a foam agent (BASF Glucopon 225DK), 2 to 6 parts by mass of a thickener (TEGO Chemical 3030).

Basic formula 3: The formula of solvent-based polyurethane fully coated shielding layer: 1000 parts by mass of a dry polyurethane resin (Xuchuan XCS-3030L), 800 to 2000 parts by mass of the DMF (reagent), 3-10 parts by mass of the defoamer (BYK-016), 3 to 8 parts by mass of the leveling agent (TEGO Flow425), 3 to 8 parts by mass of the penetrating agent (AERLSOL OT-75) and 2 to 5 parts by mass of the wetting agent (DuPont Chemical Capstone FS-63).

Basic formula 4: Formula of solvent-based polyurethane fully coated moisture wicking layer: 1000 parts by mass of the wet polyurethane resin (Huafon JF-P-2930), 800 to 2000 parts by mass of the DMF (reagent), 3 to 10 parts by mass of the defoamer (BYK-016), 3 to 8 parts by mass of the penetrating agent (AERLSOL OT-75), 2 to 8 parts by mass of the cell aid (BYK-L9520) and 5 to 15 parts by mass of the accelerator (BYK-L9525).

Demonstration example 1: The process is as follows: molding of the palm body; coating in coagulant; coating in glue (foam layer); water washing; drying; coating in glue (shielding layer); drying; demolding of the finished product; and packaging.

Moisture wicking layer formula: 1000 parts by mass of the waterborne polyurethane emulsion (XWB-7510B of Xuchuan Chemical Suzhou Co., Ltd.), 60 parts by mass of the foam agent (BASF Glucopon 225DK), and 6 parts by mass of the thickener (TEGO 3030). The foam ratio is 1.2 times. The viscosity of the working slurry was measured to be 1000 centipoises.

Shielding layer formula: 1000 parts by mass of the waterborne polyurethane emulsion (XWB-7248 of Xuchuan Chemical Suzhou Co., Ltd.), 5 parts by mass of the defoamer (BYK-016), 5 parts by mass of the thickener (TEGO Chemical 3030), 3 parts by mass of the wetting agent (DuPont Chemical Capstone FS-63), 20 parts by mass of the curing agent (Bayer 3100). The viscosity of the working slurry was measured to be 1000 centipoises.

Demonstration example 2: The process is as follows: molding of the palm body; coating in coagulant; coating in glue (foam layer); water washing; drying; coating in glue (shielding layer); drying; demolding of the finished product; and packaging.

Moisture wicking layer formula: 1000 parts by mass of the waterborne polyurethane emulsion (XWB-7510B of Xuchuan Chemical Suzhou Co., Ltd.), 120 parts by mass of the foam agent (BASF Glucopon 225DK), and 4 parts by mass of the thickener (TEGO 3030). The foam ratio is 1.6 times. The viscosity of the working slurry was measured to be 980 centipoises.

Shielding layer formula: 1000 parts by mass of the waterborne polyurethane emulsion (XWB-7248 of Xuchuan Chemical Suzhou Co., Ltd.), 5 parts by mass of a defoamer (BYK-016), 5 parts by mass of the thickener (TEGO Chemical 3030), 3 parts by mass of the wetting agent (DuPont Chemical Capstone FS-63), 20 parts by mass of the curing agent (Bayer 3100). The viscosity of the working slurry was measured to be 1020 centipoises.

Demonstration example 3: The process is as follows: molding of the palm body; coating in coagulant; coating in glue (foam layer); water washing; drying; coating in glue (shielding layer); drying; demolding of the finished product; and packaging.

Moisture wicking layer formula: 1000 parts by mass of a waterborne polyurethane emulsion (XWB-7510B of Xuchuan Chemical Suzhou Co., Ltd.), 60 parts by mass of the foam agent (BASF Glucopon 225DK) and 6 parts by mass of the thickener (TEGO 3030). The foam ratio is 1.2 times. The viscosity of the working slurry was measured to be 980 centipoises.

Shielding layer formula: 1000 parts by mass of the dry polyurethane resin (Xuchuan XCS-3030L), 1000 parts by mass of the DMF (reagent), 5 parts by mass of defoamer (BYK-016), 3 parts by mass of the leveling agent (TEGO Flow425), 5 parts by mass of the penetrating agent (AERLSOL OT-75), 3 parts by mass of the wetting agent (DuPont Chemical Capstone FS-63). Measure the working slurry viscosity of 1000 centipoises.

Demonstration example 4: molding of the palm body; coating in coagulant; coating in glue (foam layer); water washing; drying; coating in glue (shielding layer); drying; demolding of the finished product; and packaging.

Moisture wicking layer formula: 1000 parts by mass of the waterborne polyurethane emulsion (XWB-7510B of Xuchuan Chemical Suzhou Co., Ltd.), 120 parts by mass of the foam agent (BASF Glucopon 225DK), and 4 parts by mass of the thickener (TEGO 3030). The foam ratio is 1.6 times. The viscosity of the working slurry was measured to be 1010 centipoises.

Shielding layer formula: 1000 parts by mass of a dry polyurethane resin (Xuchuan XCS-3030L), 1000 parts by mass of the DMF (reagent), 5 parts by mass of the defoamer (BYK-016), 3 parts by mass of the leveling agent (TEGO Flow425), 5 parts by mass of the penetrating agent (AERLSOL OT-75), 3 parts by mass of the wetting agent (DuPont Chemical Capstone FS-63). The viscosity of the working slurry was measured to be 990 centipoises.

Demonstration example 5: The process is as follows: molding of the palm body; coating in glue (foam layer); water washing; drying; coating in glue (shielding layer); drying; demolding of the finished product; and packaging.

The moisture wicking layer formula: 1000 parts by mass of the wet polyurethane resin (Huafon JF-P-2930), 1200 parts by mass of a DMF (reagent), 5 parts by mass of the defoamer (BYK-016), 5 parts by mass of the penetrating agent (AERLSOL OT-75), 2 parts by mass of a cell aid (BYK-L9520), 10 parts by mass of an accelerator (BYK-L9525). The measured viscosity of the working slurry is 1300 centipoises. The shielding layer formula: 1000 parts by mass of the waterborne polyurethane emulsion (XWB-7248 of Xuchuan Chemical Suzhou Co., Ltd.), 5 parts by mass of the defoamer (BYK-016), 5 parts by mass of the thickener (Di High Chemical Industry 3030), 3 parts by mass of the wetting agent (DuPont Chemical Capstone FS-63), 20 parts by mass of the curing agent (Bayer 3100). The viscosity of the working slurry was measured to be 950 centipoises.

Demonstration example 6: The process is as follows: molding of the palm body; coating in glue (foam layer); water washing; drying; coating in glue (shielding layer); drying; demolding of the finished product; and packaging. The moisture wicking layer formula: 1000 parts by mass of the wet polyurethane resin (Huafon JF-P-2930), 1500 parts by mass of the DMF (reagent), 5 parts by mass of a defoamer (BYK-016), 5 parts by mass of the penetrant (AERLSOL OT-75), 5 parts by mass of the cell aid (BYK-L9520), and 10 parts by mass of the accelerator (BYK-L9525). The viscosity of the working slurry is measured to be 800 centipoises.

Shielding layer formula: 1000 parts by mass of the waterborne polyurethane emulsion (XWB-7248 of Xuchuan Chemical Suzhou Co., Ltd.), 5 parts by mass of the defoamer (BYK-016), 5 parts by mass of the thickener (TEGO Chemical 3030), 3 parts by mass of the wetting agent (DuPont Chemical Capstone FS-63) and 20 parts by mass of the curing agent (Bayer 3100). The viscosity of the working slurry was measured to be 1020 centipoises.

Demonstration example 7: The process is as follows: molding of the palm body; coating in glue (foam layer); water washing; drying; coating in glue (shielding layer); drying; demolding of the finished product; and packaging. The moisture wicking layer formula: 1000 parts by mass of the wet polyurethane resin (Huafon JF-P-2930), 1200 parts by mass of the DMF (reagent), 5 parts by mass of the defoamer (BYK-016), 5 parts by mass of the penetrating agent (AERLSOL OT-75), 2 parts by mass of the cell aid (BYK-L9520) and 10 parts by mass of the accelerator (BYK-L9525). The viscosity of the working slurry was measured to be 1350 centipoises.

Shielding layer formula: 1000 parts by mass of the dry polyurethane resin (Xuchuan XCS-3030L), 1500 parts by mass of the DMF (reagent), 5 parts by mass of the defoamer (BYK-016), 3 parts by mass of the leveling agent (TEGO Flow425), 5 parts by mass of the penetrating agent (AERLSOL OT-75) and 3 parts by mass of the wetting agent (DuPont Chemical Capstone FS-63), the viscosity of the working pulp was measured to be 800 centipoises.

Demonstration example 8: The process is as follows: molding of the palm body; coating in glue (foam layer); water washing; drying; coating in glue (shielding layer); drying; demolding of the finished product; and packaging. The moisture wicking layer formula: 1000 parts by mass of the wet polyurethane resin (Huafon JF-P-2930), 1800 parts by mass of DMF (reagent), 5 parts by mass of a defoamer (BYK-016), 5 parts by mass of penetrating agent (AERLSOL OT-75), 5 parts by mass of the cell aid (BYK-L9520) and 10 parts by mass of the accelerator (BYK-L9525). The viscosity of the working slurry is measured to be 850 centipoises. The shielding layer formula: 1000 parts by mass of the dry polyurethane resin (Xuchuan XCS-3030L), 1500 parts by mass of the DMF (reagent), 5 parts by mass of the defoamer (BYK-016), and 3 parts by mass of the leveling agent (TEGO Flow425), 5 parts by mass of a penetrating agent (AERLSOL OT-75) and 3 parts by mass of the wetting agent (DuPont Chemical Capstone FS-63), the viscosity of the working pulp is measured to be 780 centipoises.

Demonstration example 9: The process is as follows: molding of the palm body; coating in coagulant; coating in glue (foam layer); water washing; drying; coating in glue (shielding layer); drying; demolding of the finished product; and packaging.

Moisture wicking layer formula: 1000 parts by mass of the waterborne polyurethane emulsion (XWB-7510B of Xuchuan Chemical Suzhou Co., Ltd.), 120 parts by mass of the foam agent (BASF Glucopon 225DK), and 4 parts by mass of the thickener (TEGO 3030). The foaming ratio is 2 times. The viscosity of the working slurry was measured to be 1010 centipoises.

Shielding layer formula: 1000 parts by mass of the dry polyurethane resin (Xuchuan XCS-3030L), 2000 parts by mass of the DMF (reagent), 5 parts by mass of the defoamer (BYK-016), 3 parts by mass of the leveling agent (TEGO Flow425), 5 parts by mass of the penetrating agent (AERLSOL OT-75), 3 parts by mass of the wetting agent (DuPont Chemical Capstone FS-63). The viscosity of the working slurry was measured to be 990 centipoises.

Demonstration example 10: The process is as follows: molding of the palm body; coating in glue (foam layer); water washing; drying; coating in glue (shielding layer); drying; demolding of the finished product; and packaging. The moisture wicking layer formula: 1000 parts by mass of the wet polyurethane resin (Huafon JF-P-2930), 2000 parts by mass of the DMF (reagent), 5 parts by mass of the defoamer (BYK-016), 5 parts by mass of the penetrating agent (AERLSOL OT-75), 5 parts by mass of the cell aid (BYK-L9520), 10 parts by mass of the accelerator (BYK-L9525). The working slurry viscosity is measured to be 550 centipoises. The shielding layer formula: 1000 parts by mass of a waterborne polyurethane emulsion (XWB-7248 of Xuchuan Chemical Suzhou Co., Ltd.), 800 parts by mass of a purified water, 5 parts by mass of the defoamer (BYK-016), 10 parts by mass of the thickener (TEGO Chemical 3030), 3 parts by mass of the wetting agent (DuPont Chemical Capstone FS-63), 20 parts by mass of the curing agent (Bayer 3100). The viscosity of the working slurry was measured to be 980 centipoises.

Performance testing standards:

Water absorption value: GB/T 1540-2002;

Air permeability: JIS-L-1096;

Moisture permeability: JIS-L-1099;

Bacterial Penetration Rate: EN374-5;

Water pressure resistance: GB/T 4744-2013; and

Abrasion test: EN388-2016.

The result of the performance test of the fully coated glove of each example is as shown in Table 1:

TABLE 1

| examples | solid content of moisture wicking layer (%) | solid content of shielding layer (%) | Thickness of moisture wicking layer (mm) | Thickness of shielding layer (mm) | Water absorption (g/m2) | breathability (cm3/cm2*s) | moisture permeability (g/m2*24 h) | water pressure (mmH2O) | durable (spin) | Bacterial penetration |
|---|---|---|---|---|---|---|---|---|---|---|
| 1 | 40 | 30 | 0.12 | 0.08 | 80 | 0.2 | 780 | 16500 | 6500 | Pass |
| 2 | 40 | 30 | 0.15 | 0.08 | 150 | 0.25 | 1050 | 14700 | 5500 | Pass |
| 3 | 40 | 15 | 0.12 | 0.06 | 70 | 0.19 | 700 | 16000 | 7000 | Pass |
| 4 | 40 | 15 | 0.16 | 0.06 | 165 | 0.23 | 800 | 14500 | 5200 | Pass |
| 5 | 14 | 30 | 0.15 | 0.08 | 120 | 0.31 | 1100 | 15500 | 7000 | Pass |
| 6 | 13 | 30 | 0.13 | 0.09 | 180 | 0.39 | 1450 | 12800 | 5800 | Pass |
| 7 | 14 | 12 | 0.15 | 0.04 | 108 | 0.28 | 1210 | 14900 | 6800 | Pass |
| 8 | 12 | 12 | 0.12 | 0.04 | 170 | 0.38 | 1380 | 13000 | 5500 | Pass |
| 9 | 40 | 10 | 0.2 | 0.03 | 180 | 0.30 | 1650 | 1890 | 2300 | Pass |
| 10 | 10 | 20 | 0.09 | 0.02 | 150 | 0.42 | 1750 | 1860 | 2100 | Pass |

From the comparison in Table 1, it can be seen that the glove prepared in Example 1 to Example 8 of the present disclosure have the functions of moisture absorption, breathability and shielding isolation, it is also wear-resistant and has low bacterial penetration rate and good protection effect. In Example 9, the foam ratio of the moisture wicking layer is too high, In Example 10, the effect is not good because the coating is too thin. It shows that the technical solution of this disclosure has a good effect.

The above is only a specific implementation of the present disclosure, but the scope of protection of the present disclosure is not limited thereto, and any changes or replacements that do not come to mind through creative work shall be covered within the scope of protection of the present disclosure. Therefore, the protection scope of the present disclosure should be determined by the protection scope defined in the claims.

What is claimed is:

1. A fully coated glove having a moisture wicking property, comprising:

a palm body that is knitted;

a moisture wicking layer fully coated on an inner surface of the palm body; and a shielding layer fully coated on an outer surface of the palm body;

wherein each of the moisture wicking layer and the shielding layer is prepared by coating using a raw material including waterborne polyurethane or solvent-based polyurethane, the moisture wicking layer is a foam layer with a thickness of 0.1 mm to 0.3 mm, the shielding layer is a non-foam layer with a thickness of 0.03 mm to 0.2 mm:

wherein a preparation process of the fully coated glove includes following steps:

molding of the palm body;

preparing the moisture wicking layer that is foamed by coating;

water washing;

drying;

preparing the shielding layer that is not foamed by coating;

drying;

demolding of a finished product; and packaging, wherein, when a second coating layer that is the shielding layer is coated, a first layer that is the moisture wicking layer is ensured to be cured and dried into a film, and a surface energy of a shielding layer coating in a liquid state is ensured to be lower than a surface energy of the moisture wicking layer, so that the shielding layer coating infiltrates into a surface of the moisture wicking layer at a maximum level and even into micropores of a surface layer.

2. The fully coated glove having a moisture wicking property according to claim 1, wherein, when the shielding layer is prepared by coating using the raw material including a waterborne polyurethane resin, a solid content of the coating is maintained between 20% and 40% and a viscosity of the coating is maintained between 500 centipoises and 2000 centipoises so as to ensure that the thickness of the shielding layer is 0.03 mm to 0.2 mm; when the shielding layer is prepared by coating using the raw material including a solvent-based polyurethane resin, the solid content of the coating is maintained between 12% and 20% and the viscosity of the coating is maintained between 300 centipoises and 1500 centipoises.

3. The fully coated glove having a moisture wicking property according to claim 2, wherein, when the shielding layer is prepared by coating using the raw material including the waterborne polyurethane resin, the raw material includes the following components: a waterborne polyurethane emulsion, a defoamer, a thickener, a curing agent, and a wetting agent; when the shielding layer is prepared by coating using the raw material including the solvent-based polyurethane resin, the raw material includes the following components: a dry polyurethane resin, DMF, the defoamer, a leveling agent, a penetrating agent, and the wetting agent.

4. The fully coated glove having a moisture wicking property according to claim 3, wherein, when the shielding layer is prepared by coating using the raw material including the waterborne polyurethane resin, the raw material includes the following components and parts by mass thereof: 1000 parts by mass of the waterborne polyurethane emulsion, 4 to 7 parts by mass of the defoamer, 3 to 8 parts by mass of the thickener, 10 to 30 parts by mass of the curing agent, and 2 to 5 parts by mass of the wetting agent; when the shielding layer is prepared by coating using the raw material including the solvent-based polyurethane resin, the raw material includes the following components and parts by mass thereof: 1000 parts by mass of the dry polyurethane resin, 800 to 2000 parts by mass of DMF, 3to 10 parts by mass of the defoamer, 3 to 8 parts by mass of the leveling agent, 3 to 8 parts by mass of the penetrating agent, and 2 to 5 parts by mass of the wetting agent.

5. The fully coated glove having a moisture wicking property according to claim 1, wherein, when the moisture wicking layer is prepared by coating using raw material including a waterborne polyurethane resin, a solid content of the coating is maintained between 20% and 40%, a viscosity is maintained between 500 centipoises and 2000 centipoises and an expansion ratio is maintained between 1.15-1.8 so as to ensure that the moisture wicking layer with the thickness of 0.1 mm to 0.3 mm; when the moisture wicking layer are prepared by coating using raw materials including a solvent-based polyurethane resin, solid content of the coating is maintained between 12% and 18% and the viscosity of the coating is maintained between 500 centipoises and 1500 centipoises.

6. The fully coated glove having a moisture wicking property according to claim 5, wherein, when the moisture wicking layer is prepared by coating using raw material including a waterborne polyurethane resin, the prepared raw material include the following components: a waterborne polyurethane emulsion, a foam agent and a thickener, a foam agent is add between 5% and 15% of the mass of the waterborne polyurethane emulsion; when the moisture wicking layer are prepared by coating using the raw material including a solvent-based polyurethane resin, the prepared raw material includes the following components: a wet polyurethane resin, a DMF, a defoamer, a penetrating agent, a cell aid, an accelerator, solid content of the coating is maintained between 12% and 18%.

7. The fully coated glove having a moisture wicking property according to claim 6, wherein, when the moisture wicking layer are prepared by coating using raw material including the waterborne polyurethane resin, the prepared raw material includes the following components and mass: 1000 parts by mass of the waterborne polyurethane emulsion, 50 to 150 parts by mass of the foam agent and 2 to 6 parts by mass of the thickener; when the moisture wicking layer are prepared by coating using the raw materials including solvent-based polyurethane resin, the prepared raw material includes the following components and mass: 1000 parts by mass of the wet polyurethane resin, 800 to 2000 parts by mass of the DMF, 3 to 10 parts by mass of the defoamer, 3 to 8 parts by mass of the penetrating agent, 2 to 8 parts by mass of the cell aid and 5 to 15 parts by mass of the accelerator.

* * * * *